US007776188B2

(12) United States Patent
Morton et al.

(10) Patent No.: US 7,776,188 B2
(45) **Date of Patent: *Aug. 17, 2010**

(54) TRANSPORT BELT FOR A MACHINE FOR PRODUCING WEB MATERIAL AND A METHOD FOR PRODUCING SUCH A TRANSPORT BELT

(75) Inventors: Antony Morton, Ben Rhydding (GB); Daniel Gronych, Heidenheim (DE); Michael Straub, Mittelstadt (DE)

(73) Assignee: Voith Patent GmbH, Heidenheim (DE)

( * ) Notice: Subject to any disclaimer, the term of this patent is extended or adjusted under 35 U.S.C. 154(b) by 532 days.

This patent is subject to a terminal disclaimer.

(21) Appl. No.: 11/749,451

(22) Filed: May 16, 2007

(65) Prior Publication Data

US 2007/0275214 A1 Nov. 29, 2007

(30) Foreign Application Priority Data

May 24, 2006 (DE) ..... 10 2006 024 343

(51) Int. Cl.
*D21F 2/00* (2006.01)
*B32B 3/30* (2006.01)

(52) U.S. Cl. ..... 162/358.4; 162/306; 162/901; 428/167; 428/220; 428/155

(58) Field of Classification Search ..... 162/116, 162/348, 358.1, 358.2, 361, 900–904, 204–207, 162/358.4, 359.1, 360.3, 362, 306; 428/163, 428/167, 131, 134, 137, 138, 156, 158–160, 428/172, 220, 155

See application file for complete search history.

(56) References Cited

U.S. PATENT DOCUMENTS

| | | | | |
|---|---|---|---|---|
| 4,206,258 | A * | 6/1980 | Balcar | 428/131 |
| 4,482,430 | A * | 11/1984 | Majaniemi | 162/358.4 |
| 4,740,409 | A * | 4/1988 | Lefkowitz | 428/131 |
| 4,842,905 | A * | 6/1989 | Stech | 428/33 |
| 5,302,251 | A * | 4/1994 | Schiel et al. | 162/358.4 |
| 6,159,880 | A * | 12/2000 | Schiel | 442/270 |
| 6,183,601 | B1 * | 2/2001 | Otto et al. | 162/205 |
| 6,726,809 | B2 * | 4/2004 | Joyce et al. | 162/358.1 |
| 2005/0233661 | A1 * | 10/2005 | Best et al. | 442/97 |

* cited by examiner

*Primary Examiner*—Eric Hug
(74) *Attorney, Agent, or Firm*—Taylor IP, P.C.

(57) ABSTRACT

A transport belt for a machine for producing a fiber material web, in particular paper or paperboard, has, on a web material side, a web material contact surface and, on a machine side, a machine contact surface, wherein a multiplicity of depressions are provided in the transport belt on the machine side.

18 Claims, 2 Drawing Sheets

TRANSPORT BELT FOR A MACHINE FOR PRODUCING WEB MATERIAL AND A METHOD FOR PRODUCING SUCH A TRANSPORT BELT

BACKGROUND OF THE INVENTION

1. Field of the Invention

This invention relates to a transport belt which can be used on machines for producing a fiber material web, such as paper or paperboard for example, for the forwarding of such fiber material web or the starting material therefor. The invention also relates to a method for producing such a transport belt.

2. Description of the Related Art

Transport belts are used for example on paper machines to pick up paper or the starting material therefor and move it through various processing stations such as press stations for example. Above all on the way through press stations or press nips, liquid is pressed out of the web material to be processed and then collects in the region of the surface of the transport belt on which the web material is being transported. In order to create, in the region of this surface, bulk in which this liquid, generally water, can be picked up and then dispersed from the web material, it is known to construct this surface of a transport belt on the web material side with depressions, for example groove or flute-like depressions. In addition to creating the required bulk for picking up the liquid, the provision of such depressions also has the advantage of making it easier for the transport belt to be released from the web material.

In the production process for such web material, for example paper or paperboard, liquid gradually collects, throughout the time in which such a machine is in operation, not only in the region of the surface of a transport belt on the web material side but also on the rear side, meaning on a machine-side surface of the transport belt, together with impurities contained in said liquid, generally particles from the starting material of the web material. Hence there is a risk of the frictional contact of a transport belt with the rollers driving said belt being impaired. Slip can thus arise, with the disadvantageous effect that the defined forward movement of the transport belt required for the production of the web material is interrupted at least briefly.

A known method of counteracting this is, for example, to provide cleaning stations which are assigned to said transport belt and clean its front side, meaning the surface on the web material side, and its rear side, meaning the machine-side surface, and remove any liquid and impurities collecting there.

What is needed in the art is a transport belt for a machine for producing web material and a method for producing such a transport belt, with which belt and method it is possible in easy and reliable manner to ensure a sound and slip-free driving contact of the transport belt with rollers or the like which drive said belt to move.

SUMMARY OF THE INVENTION

According to a first aspect of the present invention, the present invention provides a transport belt for a machine for producing a fiber material web, in particular paper or paperboard, wherein the transport belt has, on a web material side, a web material contact surface and, on a machine side, a machine contact surface, wherein a multiplicity of depressions are provided in the transport belt on the machine side.

Hence with the inventive transport belt, it is not or not only the surface of the transport belt on the web material side which is provided with depressions in order to be able to pick up a certain fraction of liquid there and transport it away from the web material. Depressions are also provided on the machine side so that it is also possible for liquid or impurities collecting on this side of the transport belt to be picked up in said depressions, thus ensuring a suitable static frictional contact between the machine contact surface of the transport belt and the drive rollers and the like.

In this case it has proven advantageous for the depressions to be elongated essentially in a longitudinal direction of the transport belt. The depressions can be constructed like grooves or flutes.

To be able to guarantee sufficient bulk for picking up liquid or impurities on the machine side of the transport belt it is proposed for the depth of the depressions to be at least 50 um. Here it has proven particularly advantageous for the depth of the depressions to lie in the range from 100 m to 1000 m, preferably from 200 m to 800 m.

Providing such depressions on the rear side, meaning on the machine side of the transport belt, results in the desired effect, as previously explained, of liquid and in particular also particles collecting more intensively in the region of these depressions. To make sure through simple measures that said depressions can be emptied again, meaning freed of liquid and particles, so that on a next pass through a processing station such as a press station of a paper machine bulk is again available for picking up liquid or particles, it is proposed for all the depressions to have a depression surface and for the surface roughness in the region of the depression surface to be smaller than the surface roughness in the region of the machine contact surface. It is thus assured on the one hand that as the result of the greater surface roughness on the machine contact surface there is sufficient forwarding friction contact with the contact rollers or the like while, on the other hand, the smaller surface roughness in the region of the depression surface enables easy releasing of the materials which collect there.

It has proven advantageous for the surface roughness in the region of the depression surface to be smaller than Rz 8 m (where Rz can be the average maximum height of the profile), preferably smaller than Rz 5 m, most preferably smaller than Rz 4 m, and for the surface roughness in the region of the machine contact surface to be greater than Rz 30 m.

The easier releasing of materials collecting in the depressions can also be promoted or achieved by the depressions having a depression surface which is coated with an adhesion-reducing material.

By constructing the transport belt such that at least some of the depressions are constructed to taper in the direction away from the machine contact surface, a large bulk or a large opening cross-section of the depressions is provided in particular directly adjacent the machine contact surface with the result that liquid and particles or the like can easily get into the depressions and can thus be quickly discharged from the machine contact surface of the transport belt.

On another embodiment provision can be made for at least some of the depressions to be constructed to expand in the direction away from the machine contact surface. A comparatively large total bulk of the depressions can thus be provided on what is also a very large machine contact surface. Through this comparatively large machine contact surface, its loading and hence also its wear can be reduced, which is an advantage.

On another alternative provision can be made for at least some of the depressions to be constructed with an essentially constant depression dimension in the direction away from the machine contact surface.

According to another aspect of the present invention, the present invention provides a method for producing a transport belt provided on a machine for producing a fiber material web, in particular paper or paperboard, including the provision of depressions on a machine side of the transport belt.

With this method it is possible to proceed for example such that the depressions are worked into a transport belt blank. Alternatively it is possible for the depressions to be molded in when producing the transport belt.

To be able to ensure the required static friction for driving the transport belt and also to be able to facilitate the releasing of materials collecting in the region of the depressions, it is proposed for the transport belt to have on its machine side a machine contact surface which, at least in some regions, is provided with a surface roughness which is greater than the surface roughness in the region of a depression surface formed in the depressions. Above all the easier releasing of materials which collect in the depressions can be effected or promoted in that, after the depressions are provided on the machine side, the transport belt is coated with an adhesion-reducing material and the adhesion-reducing material is removed from a machine contact surface of the transport belt.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
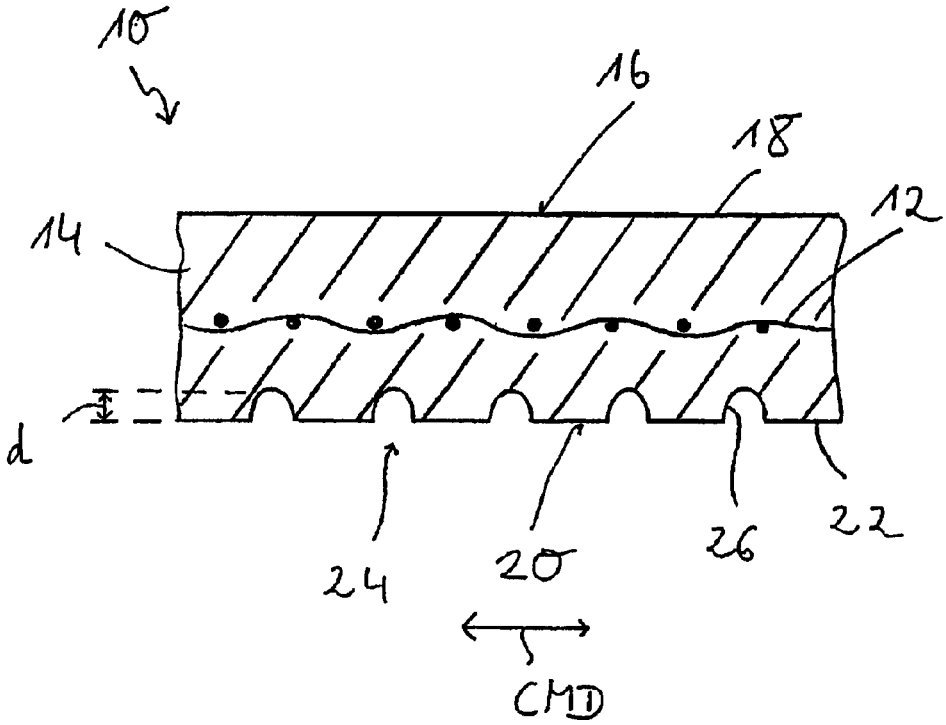
FIG. 1 shows a partial section view of an inventive transport belt with depressions on a machine side.

Referring now to the drawings, and more particularly to FIG. 1, there is shown a transport belt 10 in a sectional view, which is constructed in general such that it has, in its inner bulk region, a reinforcement structure 12 formed by a fabric or other fiber material. Said reinforcement structure 12 is embedded in or surrounded on both sides by construction material 14 of the transport belt 10. Said construction material 14 can be polymer material such as polyurethane for example. It can be made up of several layers of different materials, and provision can be made for different types of construction materials to be used on the two sides of the reinforcement structure 12. Also, provision can be made for the reinforcement structure 12 to be integrally molded in the construction material 14 or for said structure to carry, on two sides or on one side, the construction material which is applied in layers or laminated thereon.

The transport belt 10, which is constructed in principle as previously described with the reinforcement material 12 and the construction material 14, has a web material side 16 on which said transport belt 10 comes, with a web material contact surface 18, into contact with the fiber material web to be produced, for example paper or paperboard, or with the starting material therefor. On the opposite side, meaning on a machine side 20, the transport belt 10 has a machine contact surface 22. With said machine contact surface 22 the transport belt 10 is in contact with several rollers which guide said surface or drive it to move.

During the production of the fiber material web such as paper or paperboard, liquid, generally water, is pressed out of the construction material of the web material in various processing stations, in particular press stations. Said water collects primarily on the web material contact surface 18. In order not to press said liquid back into the web material, meaning in order to prevent rewetting and to discharge the liquid reliably from the web material, depressions (not shown in FIG. 1) in which said liquid can collect can be provided on the web material side 16. However, in the course of a production process such liquid will also reach the rear side, meaning the machine side 20 of the transport belt 10. Similarly, particles removed from the construction material of the web material can also travel together with the liquid into the region of the machine side 20. This could lead to a problem if, through lowering of the static friction coefficient, a frictional drive contact required with one or more drive rollers can no longer be assured, causing drive slip to occur between a drive roller and the transport belt 10.

To counteract this problem, the transport belt 10 is constructed according to the current invention with a multiplicity of depressions 24 on its machine side 20. Said depressions 24 can be constructed like grooves or flutes and can extend, as illustrated in FIG. 1, approximately perpendicular to the transverse direction CMD of the transport belt 10, meaning essentially in a longitudinal direction of the transport belt 10 orthogonal to the drawing plane of FIG. 1. According to requirements the depressions 24 can be arranged in a regular pattern as illustrated in FIG. 1, meaning they can also have a uniform distance from each other, or they can be provided in an irregular, statistically distributed pattern with regard to spacing and orientation and, if required, also dimensioning. In order to be able to provide sufficient bulk in such depressions 24 for picking up liquid or impurities, the depth d of said depressions 24 should be at least 50 m. It has proven advantageous for the depth of the depressions to lie in the range from 100 m to 1000 m, preferably from 200 m to 800 m. It can thus be assured that essentially all the liquid arising and collecting on the machine side 20, including the particles contained therein, can be picked up in the depressions 24 and that therefore a reliable frictional contact exists between the machine contact surface 22 and the drive rollers.

The materials picked up in the depressions 24 should be removed, such as after passing through a press station, from the machine side 20 of the transport belt 10 by using a cleaning device such as a cleaning scraper or a cleaning brush. For this purpose it is advantageous according to another aspect of the current invention for a depression surface 26, which is formed respectively in the region of said depressions 24, to be of a condition such that it has a surface roughness smaller than the surface roughness which is provided in the region of the machine contact surface 22 in order to maintain a sufficient static friction effect. Therefore, whereas the surface roughness in the region of the machine contact surface 22 lies preferably at a value of at least Rz 30 m, it is advantageous for the surface roughness in the region of the depression surfaces 26 to lie at a value of no more than Rz 8 m, preferably less than Rz 5 m, most preferably less than Rz 4 m. Such a smooth surface ensures the easy releasing of materials which are in the region of the depressions 24.

To produce the transport belt 10 with the depressions 24 on the machine side 20 it is possible, for example, to provide for said depressions 24 to be integrally molded or embossed already during the production of the transport belt 10, meaning when providing the construction material 14, through the use of corresponding molds or rollers. Needless to say it is also possible for said depressions 24 to be worked in with the desired depression pattern, likewise by embossing or by using a material-removing process for example, after providing a transport belt blank constructed essentially with a smooth machine side 20. With such a production method the depression surface 26 and the machine contact surface 22 are provided with approximately the same surface roughness, which can correspond essentially to the roughness required in the region of the depression surfaces 26, thus making it possible subsequently to perform a roughness treatment on the machine side 20 of the transport belt 10 in order to roughen the machine contact surface 22 and thus provide the surface roughness required there. In this way it is possible to provide different surface roughnesses in the region of the depression surface 26 on the one hand and the machine contact surface 22 on the other.

The releasing of materials contained in the depressions 24, for example in a cleaning station, can be facilitated or assisted in addition by coating the depressions 24 in the region of their depression surface 26 with an adhesion-reducing layer. Said layer can be constructed from Teflon (PTFE) for example. This adhesion-reducing layer ensures, on the one hand because of its small surface roughness and on the other hand because if its surface properties, that there is an accordingly reduced adhesive contact with the materials which collect in the depressions 24.

To be able to provide such an adhesion-reducing coating it is possible, after providing the transport belt 10 with the depressions 24, to proceed for example by covering the entire machine side 20, meaning the depression surfaces 26 and the machine contact surface 22, with said adhesion-reducing material in a layer thickness which is suitable or desired above all for the coating of the depression surfaces 26. Subsequently the machine side 20 can then be subjected to a roughing or material-removing treatment in which the adhesion-reducing material deposited on the machine contact surface 22 can then be removed again and the desired surface roughness provided in the region of the machine contact surface 22.

Figure 2:
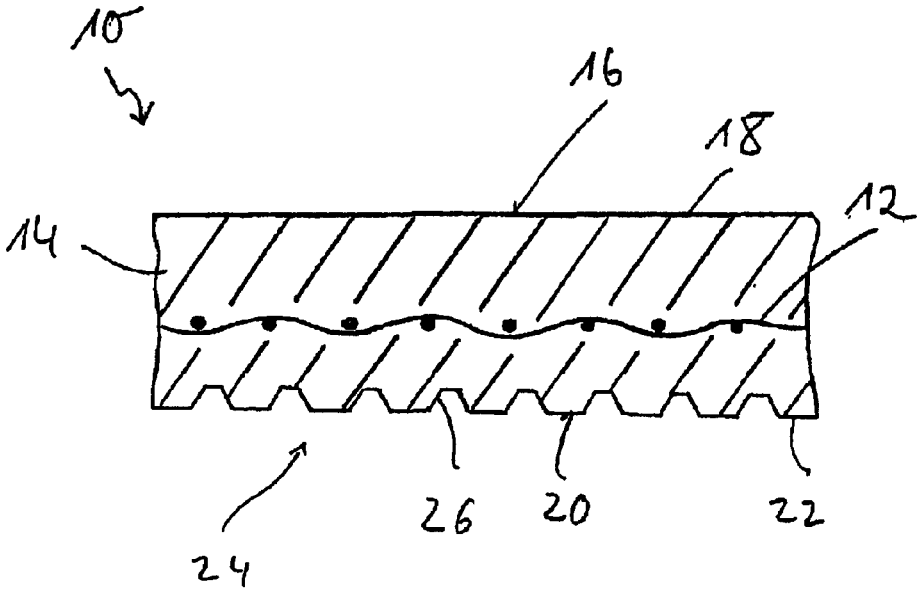
FIG. 2 shows a partial section view, corresponding to FIG. 1, of an alternative embodiment of a transport belt.

An alternative embodiment of a transport belt is shown in FIG. 2. Here identical components or sub-regions of the transport belt are given the same reference symbols as in FIG. 1. It is evident that on the embodiment shown in FIG. 2 there is a difference in the shape of the depressions 24. Like the depressions 24 on the embodiment in FIG. 1, the depressions 24 visible in FIG. 2 are constructed to taper in the direction away from the machine contact surface 22. In other words, an opening dimension decreases in the direction away from said machine contact surface 22 toward a depression bottom. But whereas on the embodiment shown in FIG. 1 this decrease in dimension or tapering shape is provided with a rounded, for example circular, oval or elliptical contour, on the embodiment in FIG. 2 provision is made for a contour of the depressions 24 which tapers in an essentially conical form.

The provision of the depressions 24 with a contour or shape which tapers away from the machine contact surface 22 ensures that comparatively large openings are formed where said depressions 24 terminate on the machine contact surface 22, with the result that any material present on the machine side 20 for picking up into the depressions gets into said depressions 24 quickly and reliably.

Figure 3:
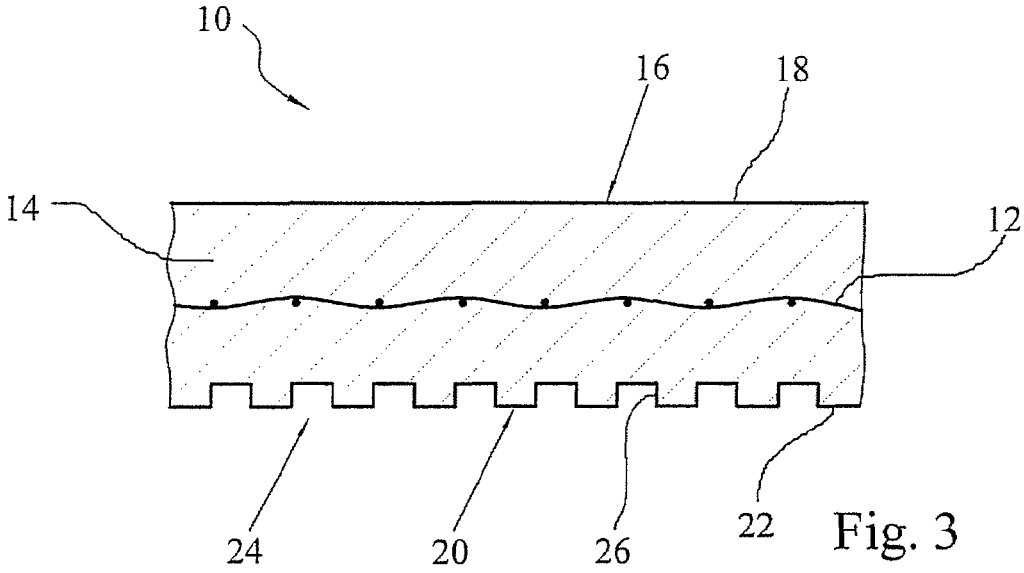
FIG. 3 shows a partial section view, corresponding to FIG. 1, of an alternative embodiment of a transport belt.

Another modification with regard to the shape of the depressions 24 is presented in FIG. 3. Here it is evident that the depressions 24 in the illustrated section are constructed to be approximately rectangular or square, meaning that in the direction away from the machine contact surface 22 they have an approximately constant depression dimension, meaning that with an elongated construction, in particular an elongated construction in the longitudinal direction of the transport belt, they have an approximately constant width. This leads to a very stable arrangement which deforms only slightly under compressive loads and thus approximately retains the pre-given bulk of the depressions 24.

Figure 4:
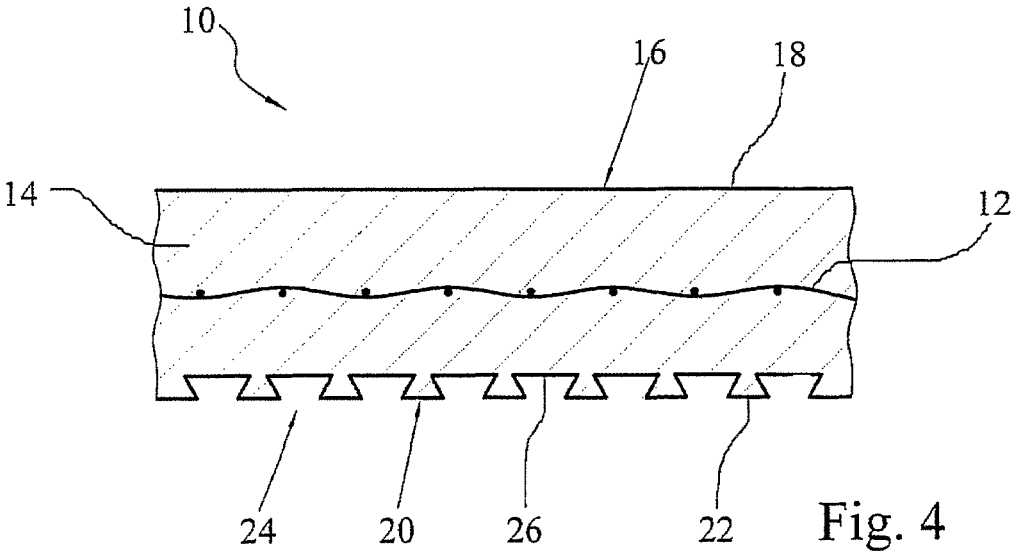
FIG. 4 shows a partial section view, corresponding to FIG. 1, of an alternative embodiment of a transport belt.

On the embodiment shown in FIG. 4, the depressions 24 are constructed to expand in the direction away from the machine contact surface 22. Here provision is made, for example, for the shape of the depressions 24 to expand in conical or dovetail form. The advantage of this embodiment is that for a comparatively large bulk of the depressions 24 the interruptions generated by said depressions 24 in the machine contact surface 22 are far less than with the embodiment shown in FIGS. 1 and 2. In other words, the total machine contact surface 22 provided on a transport belt 10 with the structure shown in FIG. 4 is greater with identical dimensioning of the transport belt 10. This leads to reduced loading of the transport belt 10 on the machine contact surface because the compressive loads which arise are distributed over a larger machine contact surface. This is a very advantageous embodiment above all with regard to the wear which occurs during operation.

Figure 5:
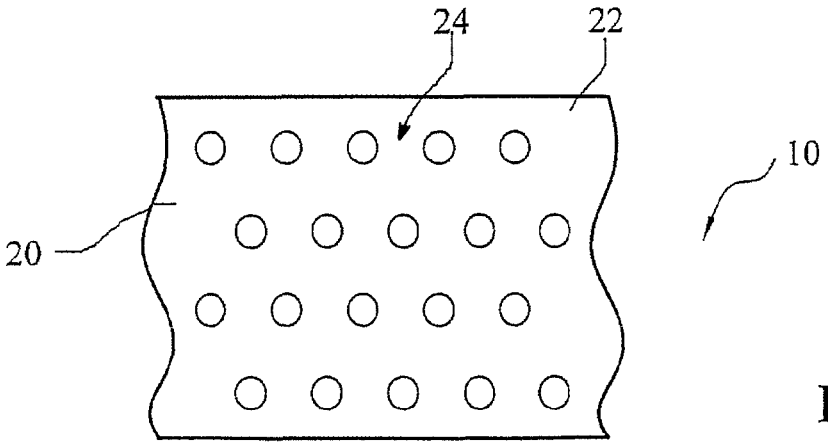
FIG. 5 shows a plan view of the machine side of another alternatively constructed transport belt.

Evident in FIG. 5 is a plan view of the machine side 20 or the machine contact surface 22 of a transport belt 10. Here again only a detail of such a transport belt 10 is shown. In FIG. 5 it is evident that the depressions 24 are not elongated in a longitudinal direction of the transport belt 10 or in a transverse direction of the transport belt 10 but are constructed as discrete depressions. Said depressions can be constructed, as shown in FIG. 5, with a circular shape, but it is also possible for them to be constructed with an oval, square, elliptical or similar shape. Needless to say, said discrete depressions 24 can be constructed, as previously illustrated, to taper, to expand or have approximately a constant dimension in the direction away from the machine contact surface 22. Said discrete depressions 24 can be distributed on the machine side 20 in a regular pattern, as is evident in FIG. 5, or they can be statistically distributed, wherein care can be taken likewise with the statistical distribution to ensure that a certain total bulk of depressions 24 is provided per pre-given unit of area.

The discretely lying depressions 24 evident in FIG. 5 can be incorporated as blind bore holes for example, but they can also be provided by applying or laminating on a bulk region of the transport belt 10 or the construction material 14 in the form of a foil or layer containing said depressions 24, wherein the depressions 24 can then be provided in said foil or layer of the construction material 14 with the desired shape, distribution and size.

With regard to the various shapes of the depressions shown, it should be noted that a combination of different shapes is possible of course. For example, in a sub-region of their extension length the depressions can extend with a constant dimension while in an adjacent region they are given a tapering or expanding contour. A combination of expanding and tapering sections of the respective depressions is also possible, as is the combination of depressions with different shapes on one and the same transport belt.

Through the inventive construction of a transport belt 10 it is thus assured in easy and reliable manner that any impurities or liquid which reach the rear side, meaning the machine side, of the transport belt do not impair the running properties of the transport belt 10 over the rollers which are guiding or driving said belt. On the one hand it is possible to ensure a sufficient static frictional contact of the machine contact surface with the guiding or driving rollers. On the other hand it is possible, through the construction of the depressions, to ensure that the materials collecting therein, for example water and particles escaping from the starting material for the web material, can be easily released from the depressions, thus preventing said depressions from gradually closing during the working life of the belt.

Finally it should again be noted that the shape, the direction of extension, the depth and the density per unit area of the depressions 24 evident in FIG. 1 can be selected to match the ambient conditions expected during use. Also, the manner in which said depressions are provided, for example through molding, embossing, a material-removing process, boring or the like, can be selected such that the depressions then formed are optimally adapted to the operating conditions existing in the specific case.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A transport belt for a machine for producing a fiber material web, said transport belt having, on a web material side, a web material contact surface and, on a machine side, a machine contact surface, said transport belt comprising a plurality of depressions in the transport belt on the machine side, each of said plurality of depressions having a depression surface with a surface roughness that is smaller than a surface roughness of the machine contact surface.

2. The transport belt according to claim 1, wherein said plurality of depressions are elongated essentially in a longitudinal direction of the transport belt.

3. The transport belt according to claim 1, wherein said plurality of depressions includes one of generally a plurality of grooves and generally a plurality of flutes.

4. The transport belt according to claim 1, wherein each of said plurality of depressions includes a depression depth which amounts to at least 50 um.

5. The transport belt according to claim 1, wherein each of said plurality of depressions includes a depression depth which lies in a range from 100 um to 1000 um.

6. The transport belt according to claim 1, wherein each of said plurality of depressions includes a depression depth which lies in a range from 200 um to 800 um.

7. The transport belt according to claim 1, wherein said surface roughness of said depression surface is smaller than Rz 8 um.

8. The transport belt according to claim 1, wherein said surface roughness of said depression surface is smaller than Rz 5 um.

9. The transport belt according to claim 1, wherein said surface roughness of said depression surface is smaller than Rz 4 um.

10. The transport belt according to claim 1, wherein said surface roughness of the machine contact surface is greater than Rz 30 um.

11. The transport belt according to claim 1, wherein each of said plurality of depressions have a depression surface which includes a coating of an adhesion-reducing material.

12. The transport belt according to claim 1, wherein at least some of said plurality of depressions taper in a direction away from the machine contact surface.

13. The transport belt according to claim 1, wherein at least some of said plurality of depressions expand in a direction away from the machine contact surface.

14. The transport belt according to claim 1, wherein at least some of said plurality of depressions include an essentially constant depression dimension in a direction away from the machine contact surface.

15. The method for producing a transport belt for a machine for producing a fiber material web, said method comprising the step of forming a plurality of depressions on a machine side of the transport belt, the transport belt having, on said machine side of the transport belt, a machine contact surface which, at least in some regions, includes a surface roughness which is greater than a surface roughness of a depression surface formed in said plurality of depressions.

16. The method according to claim 15, wherein said plurality of depressions are worked into a transport belt blank.

17. The method according to claim 16, wherein said plurality of depressions are molded during production of the transport belt.

18. The method according to claim 15, further comprising the steps of, after forming said plurality of depressions on said machine side, coating the transport belt with an adhesion-reducing material and removing said adhesion-reducing material from a machine contact surface of the transport belt.

* * * * *

UNITED STATES PATENT AND TRADEMARK OFFICE

CERTIFICATE OF CORRECTION

PATENT NO. : 7,776,188 B2
APPLICATION NO. : 11/749451
DATED : August 17, 2010
INVENTOR(S) : Antony Morton et al.

It is certified that error appears in the above-identified patent and that said Letters Patent is hereby corrected as shown below:

COLUMN 2

At line 16, delete “from 100 m to 1000 m,”, and substitute therefore --from 100 um to 1000 um,--;
At line 17, delete “from 200 m to 800 m.”, and substitute therefore --from 200 um to 800 um.--;
At line 38, delete “Rz 8 m”, and substitute therefore --Rz 8 um--;
At line 40, delete “Rz 5 m,”, and substitute therefore --Rz 5 um,--;
At line 41, delete “Rz 4 m,”, and substitute therefore --Rz 4 um--; and
At line 42, delete “Rz 30 m.”, and substitute therefore --Rz 30 um.--.

COLUMN 4

At line 42, delete “at least 50 m.”, and substitute therefore --at least 50 um.--;
At line 44, delete “from 100 m to 1000 m,”, and substitute therefore --from 100 um to 1000 um,--;
At line 44, delete “from 200 m to 800 m.”, and substitute therefore --from 200 um to 800 um.--;
At line 62, delete “Rz 30 m,”, and substitute therefore --Rz 30 um,--;
At line 64, delete “Rz 8 m,”, and substitute therefore --Rz 8 um,--;
At line 65, delete “Rz 5 m,”, and substitute therefore --Rz 5 um,--; and
At line 65, delete “Rz 4 m.”, and substitute therefore --Rz 4 um.--.

Signed and Sealed this
Fourth Day of October, 2011

David J. Kappos

David J. Kappos
*Director of the United States Patent and Trademark Office*